US005560480A

United States Patent [19]

Singleton

[11] Patent Number: 5,560,480

[45] Date of Patent: Oct. 1, 1996

[54] SOCKET HOLDER APPARATUS

[76] Inventor: Robert P. Singleton, 2028 Brandywine Ct., Birmingham, Ala. 35216

[21] Appl. No.: 336,201

[22] Filed: Nov. 4, 1994

[51] Int. Cl.[6] ..... B65D 85/20

[52] U.S. Cl. ..... 206/373; 206/378; 206/818

[58] Field of Search ..... 206/372, 373, 206/376, 378, 818, 379; 211/70.6, DIG. 1

[56] References Cited

U.S. PATENT DOCUMENTS

| | | | |
|---|---|---|---|
| 1,916,918 | 7/1933 | Carroll . | |
| 3,405,377 | 10/1968 | Pierce . | |
| 4,484,682 | 11/1984 | Crow . | |
| 4,591,817 | 5/1986 | Miller . | |
| 4,711,353 | 12/1987 | Rozmestor . | |
| 4,802,580 | 2/1989 | Andersen . | |
| 5,080,230 | 1/1992 | Winnard . | |
| 5,344,012 | 9/1994 | Matthews | 206/378 X |
| 5,409,560 | 4/1995 | Hammer et al. | 206/378 X |

*Primary Examiner*—Jacob K. Ackun
*Attorney, Agent, or Firm*—Nies, Kurz, Bergert & Tamburro

[57] ABSTRACT

A socket holder for a set of wrench sockets can be magnetically attached to any metal surface while firmly securing the sockets therein. The socket holder has individual sleeves, each capable of receiving a socket, and a radial contracting member secured to each sleeve within the holder for the purpose of gripping the socket as it is placed within the sleeve. In one embodiment of the invention, the radial contracting member is in the form of a resilient gasket attached to the inner walls of each sleeve. In another embodiment of the invention, the radial contracting member is a foam pad secured between the outer shell and a spacer plate, wherein the foam pad has pre-cut holes to align with the socket holder sleeves.

16 Claims, 4 Drawing Sheets

SOCKET HOLDER APPARATUS

BACKGROUND OF THE INVENTION

1. Field of the Invention

This invention relates to wrench sockets, and more particularly to apparatus for storing socket wrench heads, commonly referred to as "sockets", securely and conveniently when not in use.

2. Description of Related Art

Past socket holders have suffered from being unable to provide socket wrench users with a sufficiently mobile socket holder which is readily accessible in even the most awkward areas such that the user is not required to move from the attained location to retrieve the correct size socket. Additionally, past socket holders have suffered from insecure retention of the sockets, often resulting in sockets falling out whenever the holder is suddenly jolted or placed at an unusual angle, such as upside down.

Prior art socket holders are described, for example, in the following U.S. patents: U.S. Pat. No. 1,916,918 to Carroll; U.S. Pat. No. 3,405,377 to Pierce; U.S. Pat. No. 4,484,682 to Crow; U.S. Pat. No. 4,591,817 to Miller; U.S. Pat. No. 4,711,353 to Rozmestor; U.S. Pat. No. 4,802,580 to Andersen; and U.S. Pat. No. 5,080,230 to Winnard.

SUMMARY OF THE INVENTION

By the present invention, there is provided a socket holder with a base formed with magnetic material which allows the holder to be securely placed against any metallic surface. Additionally, the socket holder is provided with sleeves for positioning the sockets within the holder. In one embodiment, resilient tubing material is attached to the sleeves to securely retain sockets placed within the sleeves regardless of the angular position of the socket holder.

It is thus a primary object of the present invention to provide a socket holder which can be placed in any position or angle and still retain sockets securely.

It is another object of the present invention to provide an easily movable and easily operable storage container for sockets used with a socket wrench.

It is an additional object of the present invention to provide a socket holder in which the sockets will not tip out or otherwise become unintentionally dislodged.

It is a further object of the present invention to provide a socket holder which can be readily moved about and easily attached to any metallic surface in the working environment.

DESCRIPTION OF THE PREFERRED EMBODIMENTS

Figure 1:
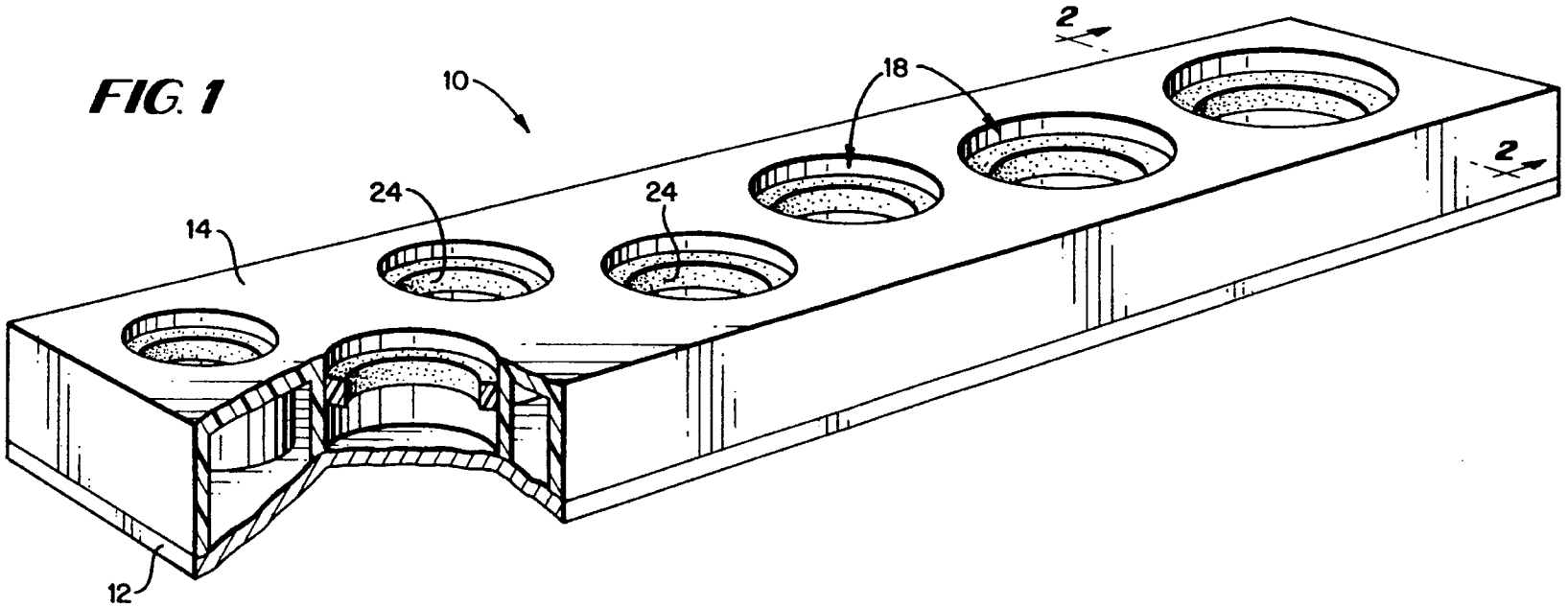
FIG. 1 is a perspective view in partial cross-section of a first embodiment of the present invention.

Referring to FIGS. 1 through 6, there is shown a socket holder 10 having a substantially rectangular cross-section with a planar base member 12 and an upper frame member 14 which can be in the form of a hollow shell. The shell 14 can be formed of plastic and secured to the base 12 by screws 16 inserted under the base 12. The base 12 can be formed with a nonmetallic binder containing magnetic material and therefore can be attachable to any metallic surface to afford the user a great range of potential locations for the socket holder 10. In one embodiment, the base 12 is formed with magnetic material only in the lower surface thereof, so that magnetic attractive force is exerted downwardly from said base 12 but not upwardly toward the sockets. The base 12 can be formed initially with magnetic material embedded in the binding material or, alternatively, a powdered metallic material such as iron oxide can be mixed with liquid binder and then be magnetized after molding of the binder material.

The shell 14 has cylindrical openings 18 defined by sleeves 20 which establish the areas in which sockets may be stored. In one embodiment of the invention, some of the openings 18 are of the same size and some are of different sizes to enable the socket holder 10 to accommodate different size sockets. Additionally, the openings 18 may be symmetrically aligned along the longitudinal axis of the socket holder 10 or, alternatively, the openings 18 may be offset from the longitudinal axis, as shown in FIG. 1.

Figure 2:
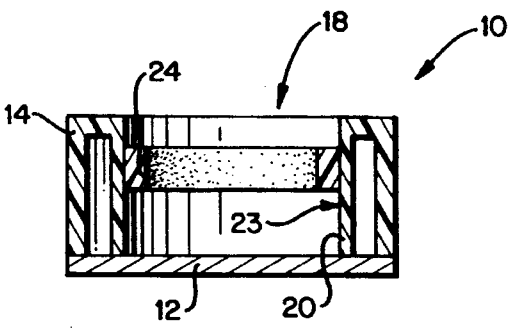
FIG. 2 is a cross-sectional view of the socket holder taken along line 2—2 of FIG. 1.
Figure 3:
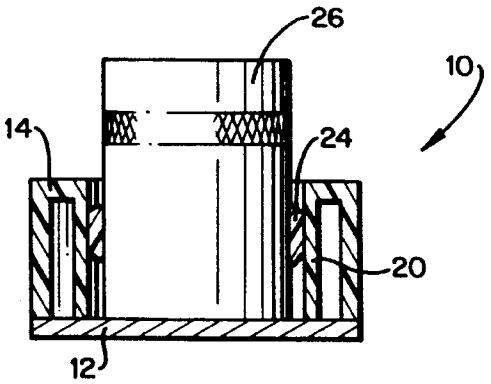
FIG. 3 is a cross-sectional view of the socket holder of FIG. 2 showing the insertion of a socket.

A resilient member 24 acts to securely retain the sockets by exerting a radially contracting force around each socket inserted in the sleeves 20. In one embodiment of the invention, as shown in FIGS. 1 through 3, the resilient member 24 is a gasket of rubber or similar material radially disposed about the inner wall portion 23 of sleeve 20. The gasket 24 can be a high-density foam formed of a nitrile rubber and PVC blend, with the gasket 24 being glued to the inner wall portion 23 of sleeve 20. The gasket 24 is preferably positioned in the upper portion of the sleeve 20 and has an inner diameter which is less than that of the socket to be inserted.

In operation, as shown in FIG. 3, a socket 26 to be placed within the socket holder 10 is inserted into the opening 18 created by the sleeve 20 and further inserted through the central opening of the gasket 24. As the socket 26 is further inserted into the sleeve 20 past the gasket 24, gasket 24 is forced outwardly and exerts a radially inward contracting force on the socket 26 to snugly maintain it within the sleeve 20.

Figure 4:
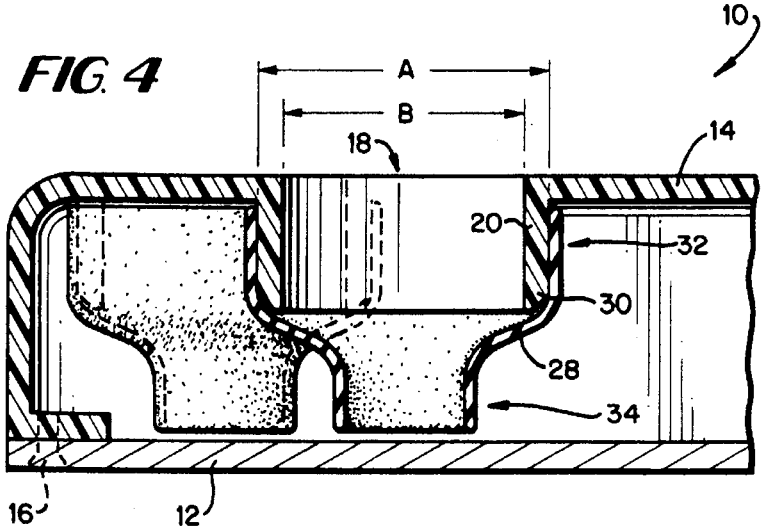
FIG. 4 is a cross-sectional view showing a second embodiment of the socket holder of the present invention.
Figure 5:
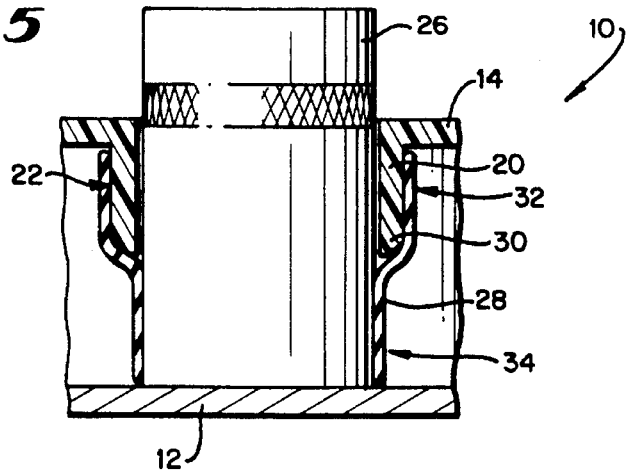
FIG. 5 is a cross-sectional view of the socket holder of FIG. 4 showing the insertion of a socket.

In another embodiment of the invention as shown in FIG. 4, the resilient member can be a segment of rubber tubing 28 which can be of a rubber latex material. In this embodiment, the upper portion 32 of rubber tubing 28 is stretched outwardly to fit around the sleeve 20 and thus upper portion 32 maintains a tight seal against the sleeve 20 by exerting a radial contracting force. The tubing lower portion 34 extends below the sleeve 20 and is positioned radially inwardly of the sleeve 20 when resting unexpanded. Additionally, the sleeve lower edge 30 may be angled radially inwardly to provide a gradual taper for the rubber tubing 28. As shown in FIG. 5, the upper portion 32 of the rubber tubing 28 extends upwardly to the shell 14 and, when expanded, the lower portion 34 extends to the metallic base 12. In another embodiment of the invention, as shown in FIG. 6, the upper portion 32 of the rubber tubing 28 extends over a radial lip 35 on the outer wall portion 22 of sleeve 20.

Figure 6:
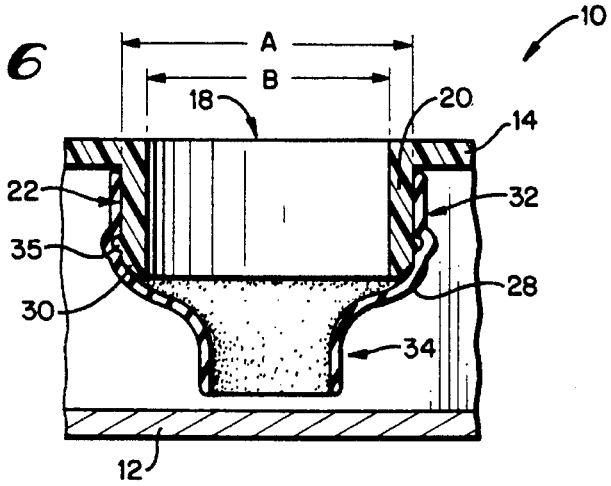
FIG. 6 is a cross-sectional view showing a third embodiment of the socket holder of the present invention.

As shown in FIGS. 4 through 6, the inside diameter of the top portion 32 of the resilient member 28 can be expanded to be at least equal to the outside diameter "A" of sleeve 20. The lower portion 34 of the resilient member 28 can be expanded such that the maximum inside diameter is at least equal to the inside diameter "B" of sleeve 20. With this arrangement, the upper portion 32 is thus expanded further than the lower portion 34 and thereby exerts a stronger radial contracting force which allows a socket to be readily inserted into and removed from the lower portion 34 without affecting the snug fit of upper portion 32 against the outer portion 22 of sleeve 20.

In one embodiment of the invention shown in FIGS. 4 and 6, the outside diameter "A" of sleeve 20 can range from 1⅛ inch to 1½ inch and the inside diameter "B" of sleeve 20 can range from 15/16 inch to 15/16 inch. The openings 18 defined by the inner diameter "B" of sleeves can all be the same size or may be different sizes.

As shown in FIG. 5, in operation of the invention having the sleeve arrangement of FIG. 4, a socket 26 to be placed within the socket holder 10 is inserted into the opening 18 created by the sleeve 20 and resiliently retained by the radial contracting force exerted by rubber tubing 28. When the socket 26 is inserted past the lower edge 30 of the sleeve 20, it begins to expand the lower portion 34 of the rubber tubing 28. As the lower portion 34 expands, it creates a radial contracting force on the socket 26 to retain it snugly within the sleeve 20 while the upper portion 32 of rubber tubing 28 maintains the snug fit on the outer wall portion 22 of sleeve 20.

Figure 7:
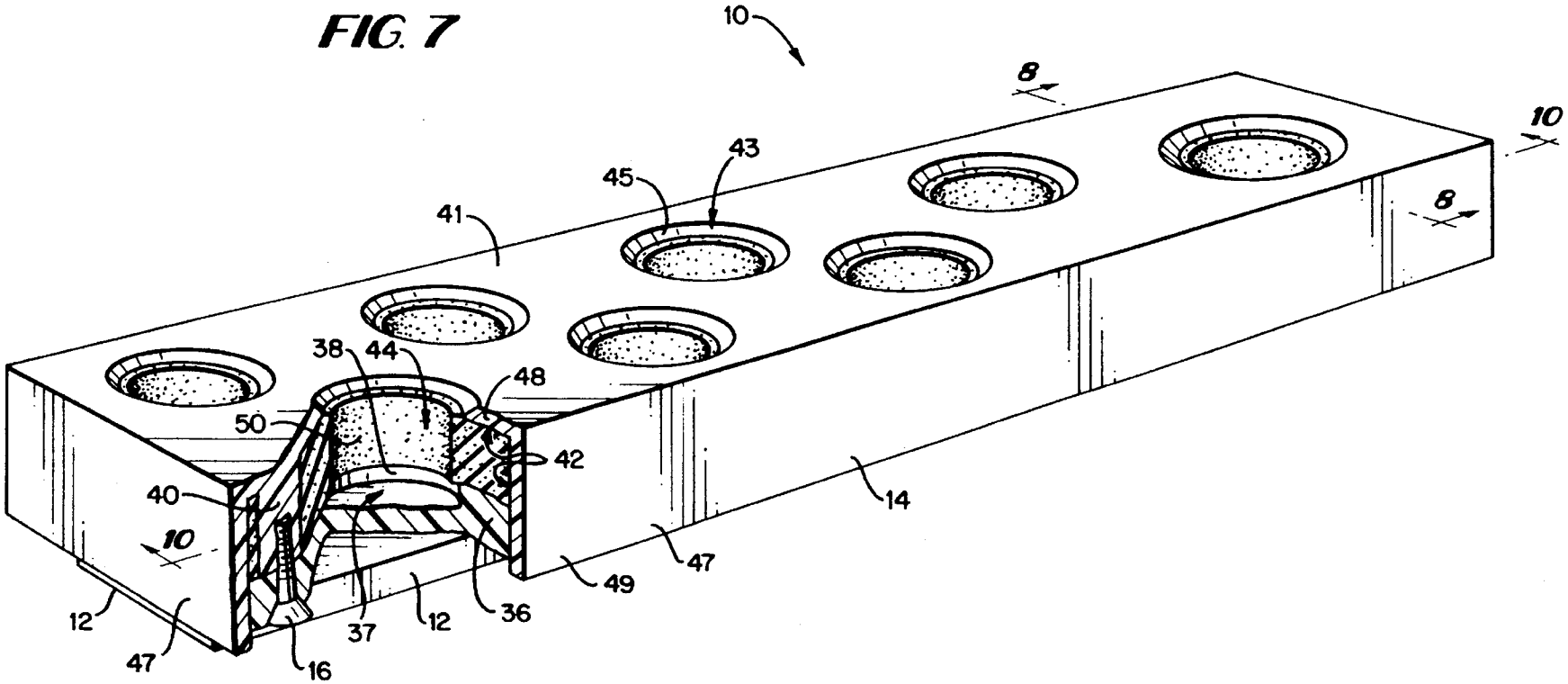
FIG. 7 is a perspective view in partial cross-section showing a fourth embodiment of the socket holder of the present invention.
Figure 8:
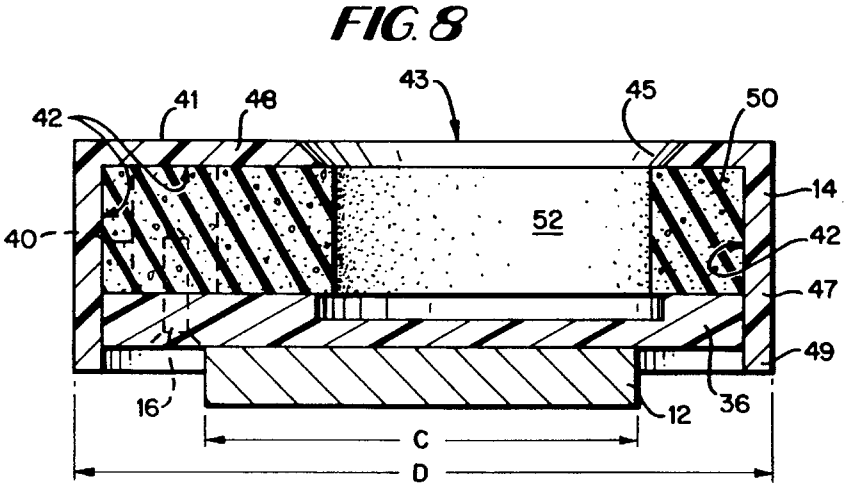
FIG. 8 is a cross-sectional view of the socket holder of FIG. 7 taken along line 8—8 of FIG. 7.
Figure 10:
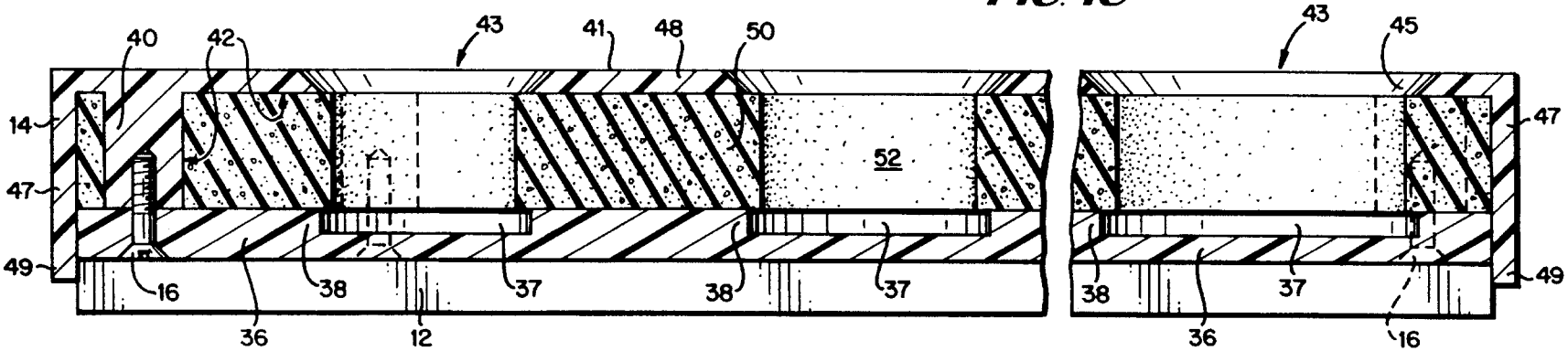
FIG. 10 is a cross-sectional view of the socket holder of FIG. 7 taken along line 10—10 of FIG. 7.

In a preferred embodiment of the invention as shown in FIGS. 7 through 10, the socket holder 10 is provided with a one piece, plastic injection spacer plate 36 in addition to the base 12 and shell 14 wherein the spacer plate 36 has cylindrical shaped grooves 37 defined by upper wall portions 38. The base 12 has a width "C" less than the width "D" of the shell 14, as shown in FIG. 8. The spacer plate 36 and the shell 14 are attached to the base 12 by glue or similar adhesive material. The shell 14 is attached to the spacer plate 36 by screws 16 or the like inserted under the spacer plate 36 into shell post members 40 which extend from the upper wall portion 48 of the shell 14 to the upper wall portion 38 of the spacer plate 36. A series of openings 43 are provided in the upper wall portion 48. As in the case of the previous embodiments, the openings 43 may be aligned along the longitudinal axis or, alternatively, offset from the longitudinal axis as shown in FIG. 7.

In one embodiment of the invention, the outer surface 41 of upper wall 48 has a radially inward taper 45 around each of the openings 43. The grooves 37 in the spacer plate 36 are aligned with the shell openings 43. Further, the inner wall surfaces 42 of the shell 14 cooperate with the upper wall portions 38 of the spacer plate 36 to define a cavity within the socket holder 10.

Figure 9:
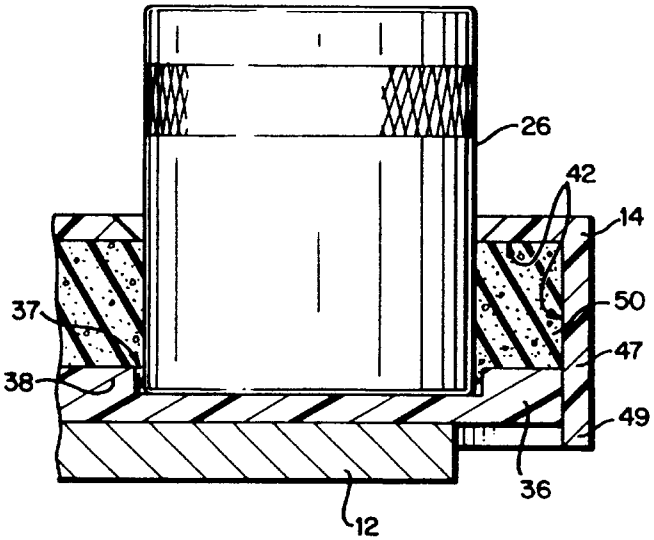
FIG. 9 is a cross-sectional view of the socket holder of FIG. 8 showing the insertion of a socket.

A resilient member 50 is employed to fit within the cavity. In one embodiment, the resilient member 50 is a one-piece foam pad secured between the spacer plate 36 and the outer shell 14 by the shell and shell post members 40 which fit through notches in the foam pad 50. The pad 50 is also provided with holes 52 spaced to align with the openings 43 in the outer shell 14 and the grooves 37 of the spacer plate 36. The pad holes 52 are of smaller diameter than the outer shell openings 43 and the spacer plate grooves 37 as shown in FIG. 8. Thus, when a socket 26 is completely inserted in the sleeve portion 44, as shown in FIG. 9, a portion of the foam pad 50 is downwardly deflected into the groove 37 of the spacer plate 36, thus ensuring a snug fit of the socket 26 within the socket holder 10.

In one embodiment, the outer side walls 47 of the shell 14 are provided with downward extensions 49 which extend below the spacer plate 36 and act to help secure the magnet to the spacer plate by resisting shearing forces, protect the surface to which the socket holder 10 is attached. In a further embodiment of the invention, the shell 14 is provided with an outwardly projecting handle member which allows the socket holder 10 to be hung on a nail, for example, or any location such as a wooden post where insufficient magnetic attractive forces are present.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed and desired to be secured by Letters Patent is:

1. A socket holder, comprising:

a base member;

an upper frame member attached to said base member, said upper frame member having at least one tubular sleeve with an inner wall portion; and radial contracting means secured to said at least one sleeve, capable of contact with a socket, a bit, or cylindrical tool inserted into said sleeve so as to exert a resilient radial inward force for securely maintaining said socket, bit or cylindrical tool said radial contracting means including a resilient gasket radially disposed about the inner wall portion of said at least one sleeve.

2. The socket holder of claim 1 wherein the base member is formed to include magnetic material so as to be removably attachable to a metallic surface.

3. The socket holder of claim 1 wherein said gasket is located about the vertical axis of said tubular sleeve.

4. The socket holder of claim 1 including a plurality of sleeves of different diameters.

5. The socket holder of claim 2 wherein said magnetic material of the base exerts a magnetic attractive force below said base member but not above said base member.

6. The socket holder of claim 1 wherein said upper frame member is in the form of a hollow shell.

7. A socket holder, comprising:

a base member;

an upper frame member attached to said base member, said upper frame member having at least one tubular sleeve with an outer wall portion; and radial contracting means secured to said at least one sleeve, capable of contact with a socket, a bit, or cylindrical tool inserted into said at least one sleeve so as to exert a resilient radial inward force for securely maintaining said socket, bit or cylindrical tool, said radial contracting means including a resilient tube attached to the outer wall portion of said at least one sleeve and depending downwardly of said at least one sleeve.

8. The socket holder of claim 7 wherein said at least one sleeve has a lower end, said resilient tube is circular in cross-section and has a lower end, and said resilient tube tapers radially inwardly from said sleeve lower end toward said resilient tube lower end.

9. The socket holder of claim 8 wherein said resilient tube has an upper end extending to said upper frame and wherein said resilient tube lower end extends to said base.

10. A socket holder, comprising:

a base member;

a spacer plate attached to said base member;

an outer shell having an upper wall and a plurality of side walls, with said side walls being attached to said base member, whereby said spacer plate and said outer shell define a cavity within said socket holder; and radial contracting means secured within said cavity of said socket holder, said radial contracting means being capable of exerting a resilient radial inward force for securely maintaining a socket inserted into said socket holder;

said spacer plate having an upper wall portion with at least one cylindrical shaped groove therein, wherein said upper wall portion of the outer shell has at least one opening therein and wherein said at least one groove is aligned with said at least one opening.

11. The socket holder of claim 10 wherein said outer shell includes side walls which extend to a position below said spacer plate.

12. The socket holder of claim 10 wherein the width of said base member is less than the width of said outer shell.

13. The socket holder of claim 10 wherein said radial contracting means includes a resilient foam pad.

14. The socket holder of claim 13 wherein said foam pad includes at least one hole which is aligned with said at least one groove and said at least one opening.

15. The socket holder of claim 14 wherein said at least one hole is of smaller diameter than said at least one groove and said at least one opening.

16. The socket holder of claim 10 wherein said outer shell has a plurality of openings and said spacer plate has a plurality of grooves with each groove being aligned with a respective opening and wherein said openings are symmetrically aligned along the longitudinal axis of said socket holder.

* * * * *

UNITED STATES PATENT AND TRADEMARK OFFICE

CERTIFICATE OF CORRECTION

PATENT NO. : 5,560,480

DATED : October 1, 1996

INVENTOR(S) : Robert P. Singleton

It is certified that error appears in the above-indentified patent and that said Letters Patent is hereby corrected as shown below:

Column 3, line 26, after "to", cancel "15/16", insert -- 1 5/16 --.

Signed and Sealed this

Fourteenth Day of January, 1997

*Attest:*

Bruce Lehman

BRUCE LEHMAN

*Attesting Officer*

*Commissioner of Patents and Trademarks*